US005639265A

United States Patent [19]

Nishio et al.

[11] Patent Number: 5,639,265

[45] Date of Patent: Jun. 17, 1997

[54] ELECTRIC CONNECTOR

[75] Inventors: Atsushi Nishio; Soichi Takagi; Masahiro Kawamatsu, all of Ibaraki, Japan

[73] Assignee: Mitsumi Electric Co., Ltd., Tokyo, Japan

[21] Appl. No.: 505,391

[22] Filed: Jul. 21, 1995

[30] Foreign Application Priority Data

Jul. 30, 1994 [JP] Japan ..... 6-197417
Jul. 30, 1994 [JP] Japan ..... 6-197418

[51] Int. Cl.[6] ..... H01R 23/70

[52] U.S. Cl. ..... 439/637; 439/630; 439/83

[58] Field of Search ..... 439/630–637, 439/326–328

[56] References Cited

U.S. PATENT DOCUMENTS 4,439,000 3/1984 Kaufman et al. ..... 439/637
4,660,911 4/1987 Reynolds et al. ..... 439/83
5,295,843 3/1994 Davis et al. ..... 439/637
5,366,382 11/1994 Thumma ..... 439/637
5,433,616 7/1995 Walden ..... 439/637
5,476,389 12/1995 Ono ..... 439/637

*Primary Examiner*—Hien Vu
*Attorney, Agent, or Firm*—Whitham, Curtis, Whitham & McGinn

[57] ABSTRACT

An electrical connector wherein no clearance is produced between the bent terminal portion and the insertion portion, which in turn prevents the bent terminal portion from moving along the length of the electric connector. As a result, a distance α between adjacent bent terminal portions can be kept constant, thereby allowing a wiring pattern of a wiring board on which the electric connector is placed to coincide with the bent terminal portions, increasing the soldering area, and hence improving the strength of soldering against the separation of soldered parts.

19 Claims, 5 Drawing Sheets

ELECTRIC CONNECTOR

BACKGROUND OF THE INVENTION

1. Field of the Invention

The invention relates to electric connectors to be surface-mounted on a wiring board. In particular, the invention is directed to an electric connector having a predetermined number of contact fittings, each being bent so as to be substantially 7-shaped or inverted U-shaped and being designed to be brought into contact with a flexible printed card (FPC) that is inserted into the electric connector.

2. Related Art

An exemplary conventional electric connector for FPCs of this type is shown in FIGS. 3 A, B and C and FIG. 4 (A). This electric connector 5 has a predetermined number of contact fittings 60 and a main body portion 50. Each contact fitting is bent so as to be substantially 7-shaped or inverted U-shaped. The main body portion 50 has a predetermined number of slitlike insertion portions 52 juxtaposed along the length so as to confront each other across the width. Each contact fitting 60 is inserted into the corresponding slitlike insertion portion 52.

Each contact fitting 60 is constructed of a contact piece portion 62, a straight portion 64, and a bent terminal portion 66. The contact piece portion 62 is substantially obtuse-angled so that the contact piece portion 62 is brought into contact with each of terminal portions 72 formed on both surfaces of an FPC 70 such as shown in FIG. 4 (B) which is inserted into the main body portion 50 from an upper opening 53. The straight portion 64 is formed continuously from the contact piece portion 62. The bent terminal portion 66 is about 90° bent from the straight portion 64 in a direction opposite to the contact piece portion 62. The bent terminal portion 66 is designed to be surface-mounted. As shown in FIG. 6, a press-in protuberance 67 is formed in the vicinity of the middle of the straight portion 64. The press-in protuberance 67 is designed to bite into the corresponding insertion portion 52 while projecting in the widthwise direction of the contact fitting from the contact piece portion 62 and the bent terminal portion 66.

The thus constructed contact fittings 60 are inserted into the corresponding insertion portions 52 of the main body portion 50 by squeezing each contact fitting 60 whose terminal portion 66 is not yet bent as shown in FIG. 6 from below the corresponding insertion portion 52 with the contact piece portion 62 thereof facing inward (toward the center). As a result, the press-in protuberance 67 is fixed by biting into the inner side surface of the insertion portion 52. Hence, the lower part of the contact piece portion 62 is brought into pressure contact with a central partition wall 55 of the main body portion 50 by the resiliency thereof.

Then, by bending the terminal portion 66 about 90° in the direction opposite to the contact piece portion 62, the bent terminal portion 66 becomes coplanar with the lower surface of the main body portion 50. As a result, when the electric connector 5 is placed on a wiring board 40, the bent terminal portion 66 comes in contact with the wiring pattern, and the bent terminal portion 66 and the wiring pattern are connected and fixed by soldering.

In the aforementioned conventional electric connector 5, a clearance, although very slight, is produced between the bent terminal portion 66 of the contact fitting 60 and the corresponding insertion portion 52. This is shown in FIG. 5 (partial bottom view) where the contact fittings 60 are inserted into the slitlike insertion portions 52.

The presence of such clearance causes two adjacent bent terminal portions 66 to move along the length of the electric connector and therefore makes a distance $\alpha$ between the two adjacent bent terminal portions 66 variable, and this in turn moves the bent terminal portions 66 out of position corresponding to the wiring pattern of the wiring board 40 on which the electric connector is placed. As a result, the soldering area is reduced, thereby impairing the strength of soldering against the separation of soldered parts.

Further, in the aforementioned conventional electric connector 5 for FPCs, it is required that the terminal portion 66 be bent about 90° in the direction opposite to the contact piece portion 62 after the contact fitting 60 has been squeezed into the corresponding insertion portion 52 of the main body portion 50. However, when the terminal portion 66 is bent in this way, the straight portion 64 (particularly) the upper part thereof, and the contact piece portion 62 moves toward the middle as shown by the one dot chain line in FIG. 4 (A). As a result, it is likely that the FPC 70 will not be inserted or that the contact fittings 60 will not come in good contact with the FPC 70.

SUMMARY OF THE INVENTION

In view of the aforementioned circumstances, an object of the invention is to provide an electric connector that can keep the distance between adjacent bent terminal portions constant by preventing the bent terminal portions from moving along the length of the electric connector, which can therefore prevent the bent terminal portions from being out of the wiring pattern of a wiring board on which the electric connector is placed, and which can also increase the soldering area and thereby improve the strength of soldering against the separation of soldered parts.

In view of the aforementioned circumstances, another object of the invention is to provide an electric connector that can prevent the straight portions and the contact piece portions from being inclined and moving even if the terminal portions of the contact fittings are bent after the contact fittings have been inserted into the main body portion.

To achieve the above objects, the invention is applied to an electric connector that includes a predetermined number of contact fittings and a main body portion. Each contact fitting is bent so as to be substantially 7-shaped or inverted U-shaped, and the main body portion juxtaposes slitlike insertion portions into which the contact fittings are respectively inserted. Each contact fitting is further constructed of a contact piece portion, a straight portion, and a bent terminal portion. The contact piece portion is brought into contact with a flexible printed card inserted into the main body portion. The straight portion is formed continuously to the contact piece portion. The bent terminal portion is bent from the straight portion in a direction opposite to the contact piece portion so as to be surface-mounted. The electric connector also has stopper ribs at a lower end portion of each insertion portion so that the corresponding bent terminal portion is brought into pressure contact with the stopper ribs.

To achieve the above objects, the invention is also applied to an electric connector that includes a predetermined number of contact fittings and a main body portion. Each contact fitting is bent so as to be substantially 7-shaped or inverted U-shaped. The main body portion juxtaposes slitlike insertion portions into which the contact fittings are inserted. Each contact fitting is further constructed of a contact piece portion, a straight portion, and a bent terminal portion. The contact piece portion is brought into contact with a flexible printed card inserted into the main body portion. The straight portion is formed continuously to the contact piece portion. The bent terminal portion is bent from the straight portion in a direction opposite to the contact piece portion to be surface-mounted. The contact fitting also has a holding portion formed at a lower part of the straight portion and a press-in protuberance formed on an upper part of the holding portion. The holding portion is wider than the contact piece portion and the bent terminal portion, and the press-in protuberance is designed to bite into the insertion portion.

The electric connector of the invention, which is constructed as described above, is provided as having, at the lower part of the insertion portion, the stopper ribs that are to be brought into contact with the corresponding terminal portion. Therefore, no clearance is produced between the bent terminal portion of the contact fitting and the corresponding insertion portion, which in turn prevents the bent terminal portion from moving along the length of the electric connector. As a result, the distance between the adjacent bent terminal portions can be kept constant, thereby allowing the wiring pattern of the wiring board on which the electric connector is placed to coincide with the bent terminal portions, increasing the soldering area, and hence improving the strength of soldering against the separation of soldered parts.

The electric connector of the invention, which is constructed as described above, is also provided as not only forming at the lower part of the straight portion the holding portion, which is wider than the contact piece portion and the bent terminal portion, but also as forming on the upper part of the holding portion the press-in protuberance that is designed to bite into the insertion portion. Therefore, even if the terminal portion is bent about 90° in the direction opposite to the contact piece portion, the lower part of the straight portion is held in the insertion portion without play by the holding portion, and the upper part of the straight portion is fixed by biting into the inner side surface of the corresponding insertion portion. As a result, the straight portion and the contact piece portion is totally immovable, thereby preventing both the straight portion and the contact piece portion from being inclined and moving. Hence, the possibility that the FPC will not be inserted or that the contact fittings will not come in good contact with the FPC and a like possibility can be excluded with certainty.

BRIEF DESCRIPTION OF THE DRAWINGS

FIG. 1 (B) is a sectional view taken along a line X—X of FIG. 1 (A);

FIG. 1 (C) is a sectional view taken along a line Y—Y of FIG. 1 (B);

FIG. 1 (D) and (E) are views of the contact fitting to be used in the electric connector shown in FIG. 1;

FIG. 2 (B) is a side view of FIG. 2 (A);

FIG. 2 (C) is a partially enlarged view of the main body portion with the contact fittings inserted thereinto;

FIG. 3 (B) is a side view thereof;

FIG. 3 (C) is a bottom view thereof;

FIG. 4 (B) is a view of a flexible printed card to be connected to the electric connector shown in FIGS. 3 (A) to (C);

DETAILED DESCRIPTION OF THE PREFERRED EMBODIMENT

An embodiment of the invention will now be described with reference to the drawings.

Figure 3A:
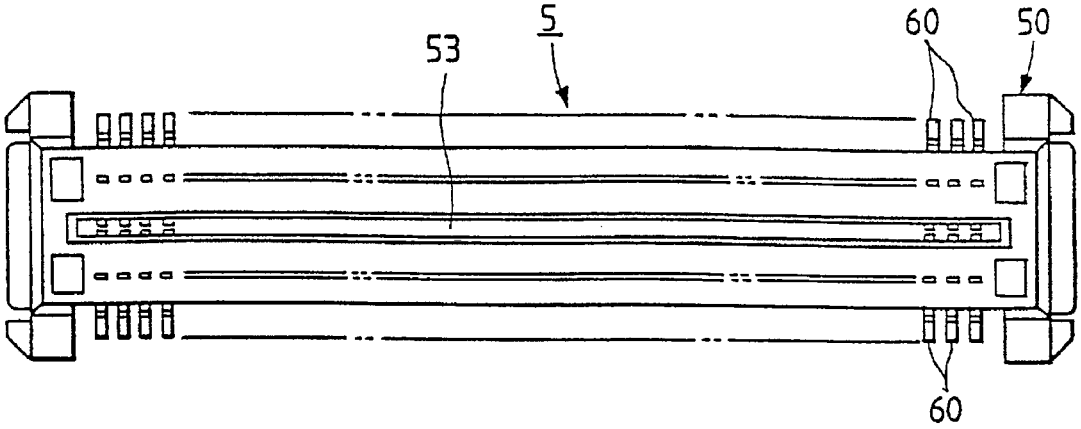
FIG. 3(A) PRIOR ART
FIG. 3 (A) is a plan view of an exemplary conventional electric connector.
Figure 3B:
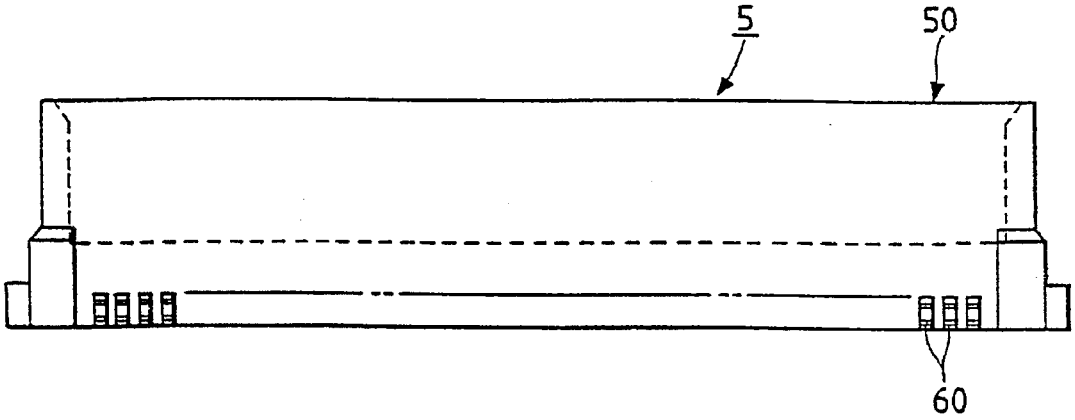
FIG. 3(B) PRIOR ART
Figure 3C:
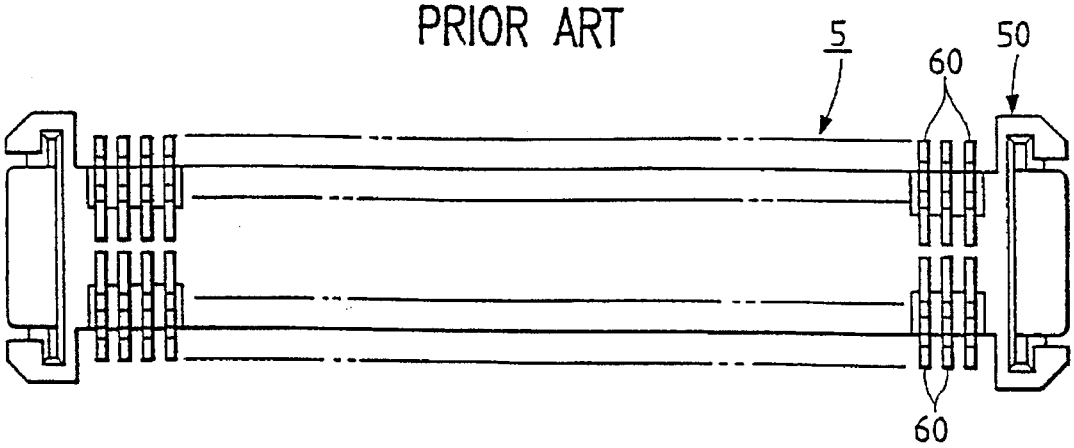
FIG. 3(C) PRIOR ART
Figure 4A:
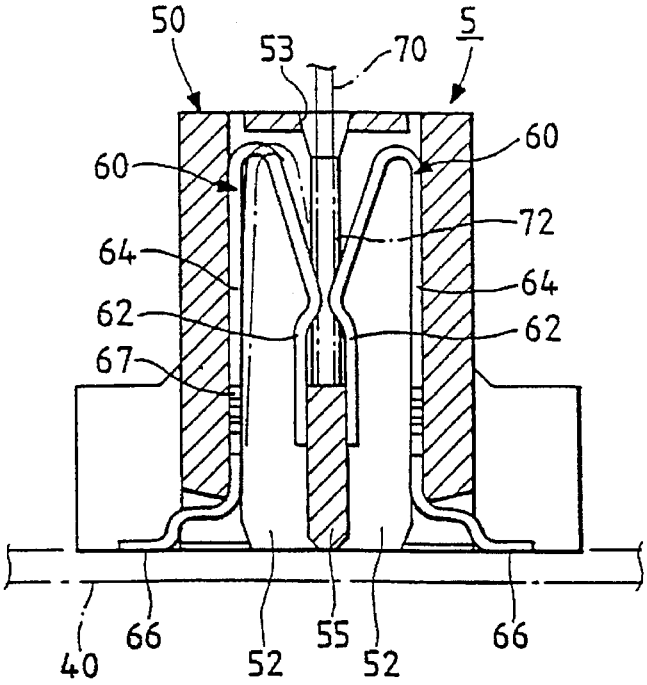
FIG. 4(A) PRIOR ART
FIG. 4 (A) is a sectional view of an exemplary conventional electric connector shown in FIGS. 3 (A) to (C)
Figure 4B:
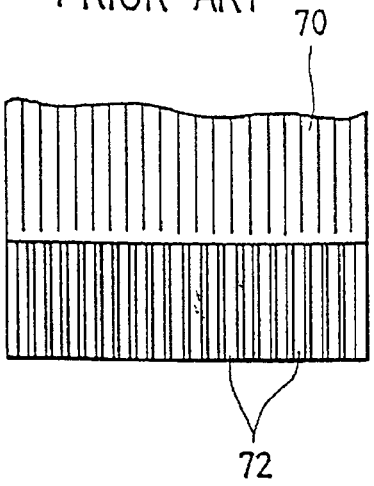
FIG. 4(B) PRIOR ART
Figure 5:
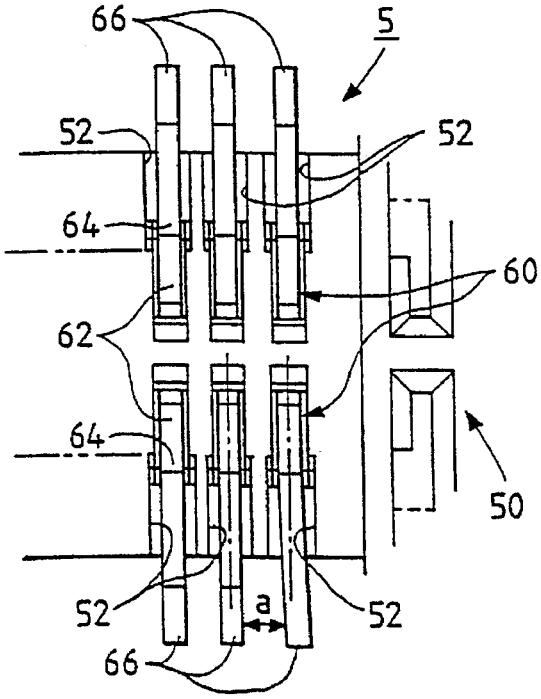
FIG. 5 PRIOR ART
FIG. 5 is a partially enlarged bottom view of the conventional electric connector shown in FIG. 3 (A) to (C)
Figure 6:
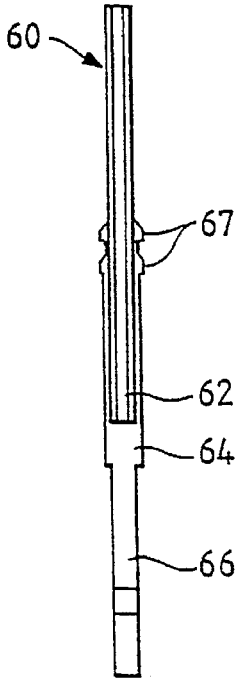
FIG. 6 PRIOR ART
FIG. 6 is a view of a contact fitting used in the conventional electric connector shown in FIG. 4 (A) and (B).

FIG. 1 (A) is a bottom view of an electric connector, which is the embodiment of the invention. Similarly to the conventional electric connector shown in FIG. 3, the electric connector 1 shown in FIG. 1 includes a predetermined number of contact fittings 20 and a main body portion 10. Each contact fitting is bent so as to be substantially inverted U-shaped. The main body portion 10 has a predetermined number of slitlike insertion portions 12 into which the contact fittings 20 are respectively inserted. The insertion portions 12 are juxtaposed along the length so as to confront each other across the width.

Each contact fitting 20 is constructed of a contact piece portion 22, a straight portion 24, and a bent terminal portion 26. The contact piece portion 22 is substantially obtuse-angled (i.e., substantially S-shaped) so that the contact piece portion 22 can be brought into contact with each of terminal portions 72 formed on both surfaces of an flexible printed card (FPC) 70 (see FIG. 1 (B)) that is inserted into the main body portion 10 from an upper opening 11. The straight portion 24 is formed continuously from the contact piece portion 22. The bent terminal portion 26, which is designed to be surface-mounted, is about 90° bent from the straight portion 24 in a direction opposite to the contact piece portion 22.

As is apparent from FIGS. 1 (C), as well as (D) and (E) in which the terminal portion 26 is inserted into the insertion portion 12 but is left unbent, a holding portion **24*a* that is wider than the contact piece portion 22 and the bent terminal portion 26 is formed at the lower part of the straight portion 24, and a press-in protuberance 27 to be forced into the insertion portion 12 is formed on the upper part of the straight portion 24. The press-in protuberance 27** has two parts, upper and lower. The upper part protuberance is shorter and is inclined so as to facilitate the press-fitting of both upper and lower part protuberances.

In addition, as shown in FIG. 1 (C), the insertion portion 12 is formed so that a lower portion **12*a* thereof into which the holding portion 24*a* is inserted is slightly wider than an upper portion 12*b* into which the press-in protuberance 27 is press-fitted so as to match the shape of the contact fitting 20**.

Figure 1A:
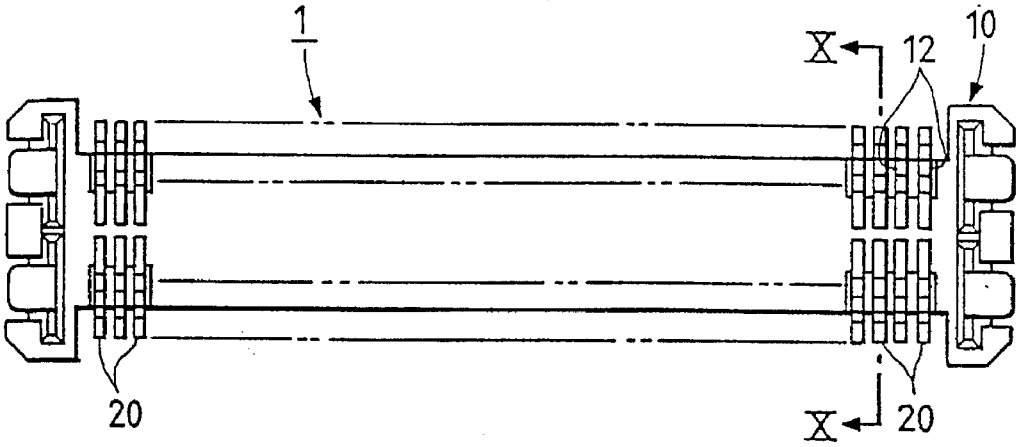
FIG. 1 (A) is a bottom view of an embodiment of the present invenion.
Figure 1B:
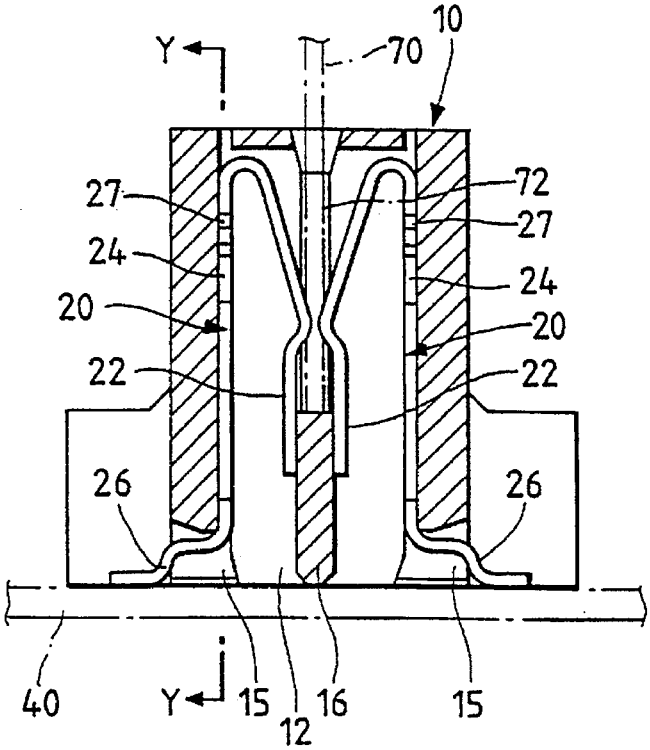
Figure 1C:
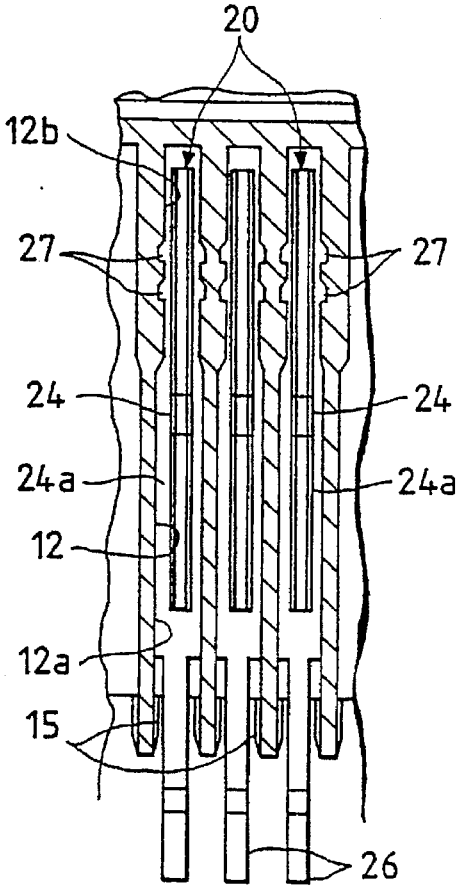
Figure 1D:
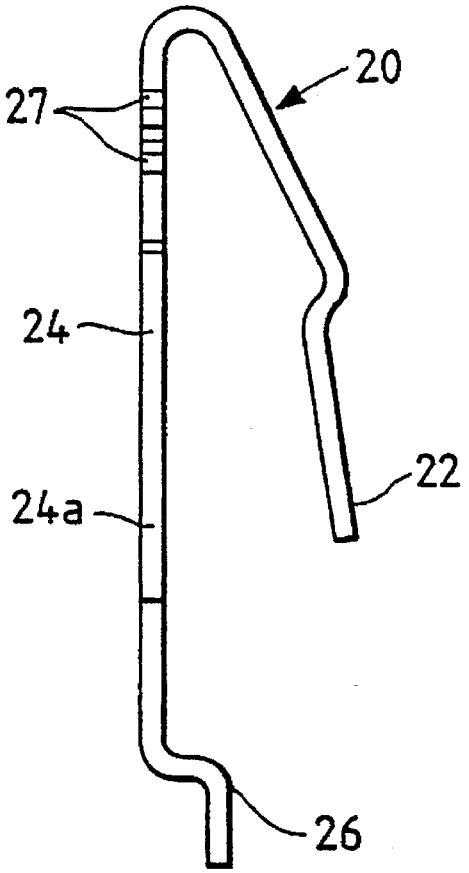
Figure 1E:
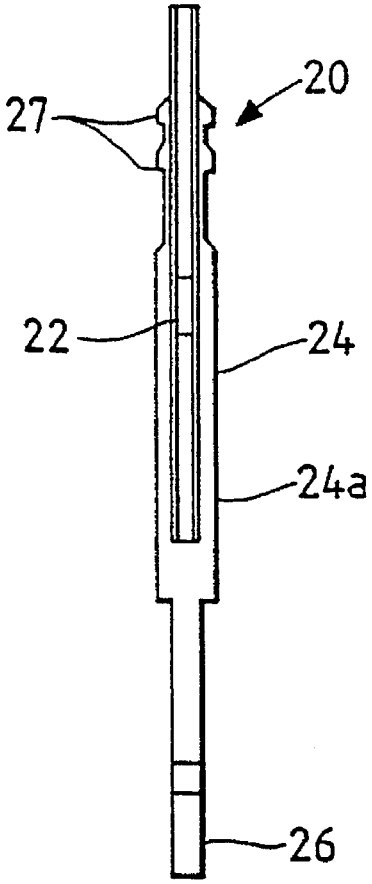
Figure 2A:
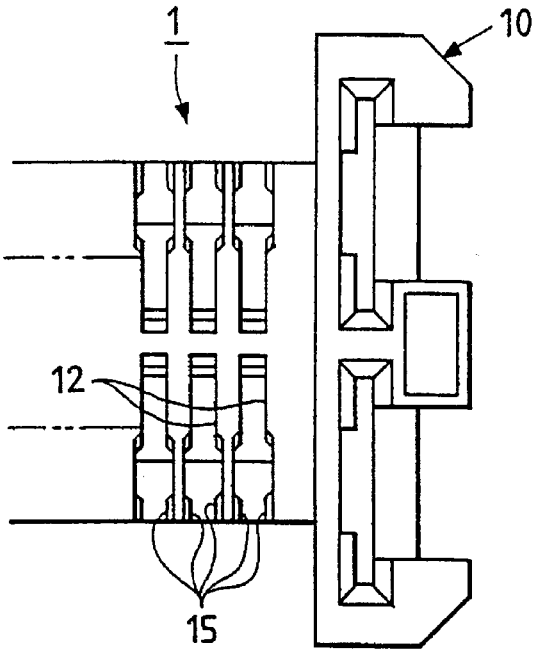
FIG. 2 (A) is an enlarged bottom view of a main body portion before contact fittings is inserted as shown in FIG. 1 (A) to (C)
Figure 2B:
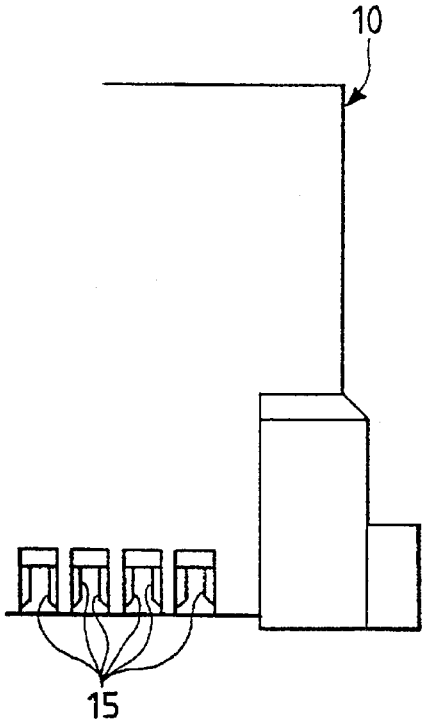
Figure 2C:
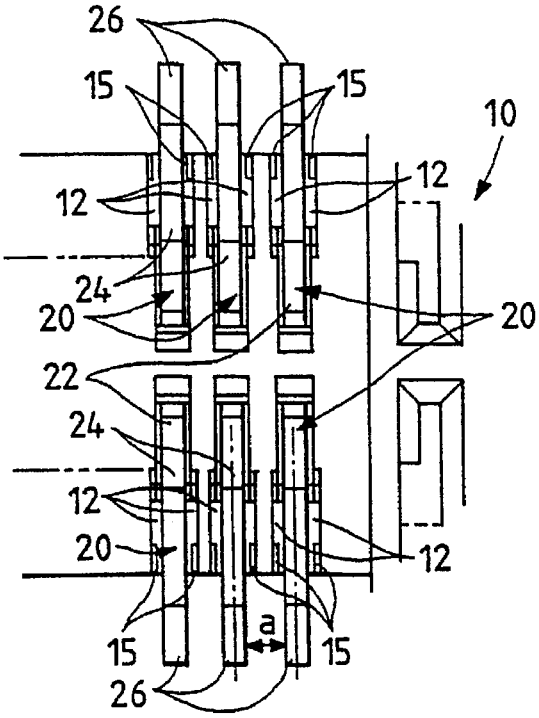

On both sides of the lowermost end portion of each insertion portion 12 are stopper ribs 15 as is apparent from FIG. 2 in addition to FIG. 1 (C). These stopper ribs 15 are designed to come in pressure contact with the corresponding bent terminal portion 26.

Under such a construction, the contact fittings 20 are inserted into the insertion portions 12 of the main body portion 10 by squeezing each contact fitting 20 (whose terminal portion 26 is not yet bent) from below the corresponding insertion portion 12 with the contact piece portion 22 thereof facing inward (toward the center). As a result, not only the holding portion **24*a* comes in pressure contact with the lower part of the insertion portion 12, but also the press-in protuberance 27 is fixed by biting into the inner side surface of the upper part 12***b* of the insertion portion 12. Hence, the lower part of the contact piece portion 22 is brought into pressure contact with a central partition wall 16 of the main body portion 10 by the resiliency thereof.

Then, by bending the terminal portion 26 about 90° in the direction opposite to the contact piece portion 22, the bent terminal portion 26 becomes coplanar with the lower surface of the main body portion 10. As a result, when the electric connector 1 is placed on a wiring board 40, the bent terminal portion 26 comes in contact with the wiring pattern, and the bent terminal portion 26 and the wiring pattern are connected and fixed by soldering.

The thus constructed electric connector 1 of the invention includes not only at the lower part of the straight portion 24 the holding portion 24*a* that is wider than the contact piece portion 22 and the bent terminal portion 26, but also on the upper part of the straight portion 24 the press-in protuberance 27 that is arranged to bite into the inner side surface of the corresponding insertion portion 12. Therefore, even if the terminal portion 26 is bent about 90° in the direction opposite to the contact piece portion 22, the lower part of the straight portion 24 remains held firmly in the lower part 12*a* of the insertion portion 12 without play.

Moreover, the upper part of the straight portion 24 is fixed by the press-in protuberance 27 biting into the inner side surface of the upper part 12*b* of the insertion portion 12. Therefore, the straight portion 24 and the contact piece portion 22 are kept totally immovable, which in turn prevents the straight portion 24 and the contact piece portion 22 from being inclined and moving. As a result, the possibility that the FPC 70 will not be inserted or that the contact fittings 20 will not come in good contact with the FPC 70 is excluded with certainty.

In addition, the electric connector 1 of the invention is further provided as having the stopper ribs 15 that are brought into pressure contact with the bent terminal portion 26 of each contact fitting 20 on both sides of the lower end of the insertion portion 12. Therefore, there is no clearance present between the bent terminal portion 26 and the insertion portion 12, which in turn prevents the bent terminal portion 26 from moving along the length of the electric connector. This further allows the adjacent bent terminal portions 26, 26 to be pitched at a constant interval α, which in turn allows the wiring pattern of the wiring board 40 on which the electric connector is carried to coincide with the bent terminal portions 26. This fact further contributes to increasing the soldering area and therefore to improving the strength of the soldering against the separation of soldered parts.

As is understood from the foregoing, the electric connector of the invention is provided as having stopper ribs at the lower end of each insertion portion so as to bring the corresponding bent terminal portion into pressure contact therewith. Therefore, no clearance is produced between the bent terminal portion of the contact fitting and the corresponding insertion portion, thereby preventing the bent terminal portion from moving along the length of the electric connector. As a result, the adjacent bent terminal portions are pitched at a constant interval, which in turn allows the wiring pattern of the wiring board on which the electric connector is carried to coincide with the bent terminal portions. Hence, this fact contributes to providing advantages such as an increase in the soldering area and an improvement in the strength of soldering against the separation of soldered parts.

Moreover, the electric connector of the invention prevents movement of the straight portion and the contact piece portion even if the terminal portion of the contact fitting is bent after the contact fitting is inserted into the main body portion. Therefore, the invention can provide the advantage of excluding with certainty the possibility that the FPC will not become properly inserted or that the contact fittings will not come in good contact with the FPC.

What is claimed is:

1. An electrical connector for connecting to a flexible printed card comprising:

a main insulative body portion;

insertion portions positioned within said main body;

a predetermined number of contact fittings, each of said contact fittings being bent so as to be substantially inverted U-shaped, the contact fittings are for being inserted into the insertion portions, each contact fitting including:

a substantially S-shaped contact piece portion for contacting a terminal portion on a surface of said flexible printed card;

a straight portion formed continuously with the contact piece portion; and a bent terminal portion connected to said straight portion said bent terminal portion being bent from the straight portion in a direction away from said contact piece portion; and stopper ribs integrally formed with said main insulative body portion and positioned at a lower end portion of each of said insertion portions so that a corresponding bent terminal portion is held in place between adjacent stopper ribs.

2. An electrical connector as in claim 1, wherein said straight portion further includes a holding portion and a press-in protuberance separated from said holding portion by an intermediate portion of said straight portion.

3. An electrical connector as in claim 1, wherein each of said stopper ribs is shaped to come in pressure contact with said corresponding bent terminal portion.

4. An electrical connector as in claim 1, wherein said main body portion includes a first surface and said bent terminal portion is coplanar with said first surface.

5. An electrical connector as in claim 1, wherein said bent terminal portion of said plurality of contact fittings have a constant interval pitch.

6. An electrical connector as in claim 1, wherein each of said contact fittings includes a press-in protuberance formed on an upper part of said straight portion.

7. An electrical connector for connecting to a flexible printed card comprising:

a main insulative body portion;

insertion portions positioned within said main body;

a predetermined number of contact fittings, each of said contact fittings being bent so as to be substantially inverted U-shaped, the contact fittings are for being inserted into the insertion portions, each contact fitting including:

a substantially S-shaped contact piece portion for contacting a terminal portion on a surface of said flexible printed card;

a straight portion formed continuously with the contact piece portion and having an upper part and a lower part; and a bent terminal portion connected to said straight portion, said bent terminal portion being bent from the straight portion in a direction away from said contact piece portion;

a holding portion formed on said lower part of the straight position, and a press-in protuberance formed on said upper part of the holding portion, the holding portion being wider than the contact piece portion and the bent terminal portion, and the press-in protuberance being for engaging with the insertion portion; and stopper ribs integrally formed with said main insulative body portion and positioned at a lower end portion of each of said insertion portions so that a corresponding bent terminal portion is held in place between adjacent stopper ribs.

8. An electrical connector as in claim 7, wherein said holding portion is separated from said press-in protuberance by an intermediate portion of said straight portion.

9. An electrical connector as in claim 7, wherein each of said stopper ribs is shaped to come in pressure contact with said corresponding bent terminal portion.

10. An electrical connector as in claim 7, wherein said main body portion includes a first surface and said bent terminal portion is coplanar with said first surface.

11. An electrical connector as in claim 7, wherein said bent terminal portion of said plurality of contact fittings have a constant interval pitch.

12. An electrical connector as in claim 7, wherein each of said press-in protuberance is formed on said upper part of said straight portion.

13. An electrical connector for connecting a flexible printed card and a circuit board, said electrical connector comprising:

an insulative housing having a plurality of insertion portions;

a plurality of contact fittings positioned within said insertion portions, said contact fittings including substantially S-shaped contact pieces for contacting terminal portions on sides of said flexible printed card and bent terminal portions for contacting said circuit board;

stopper ribs integrally formed with said insulative housing positioned within said insertion portions for holding said bent terminal portions, wherein said contact fittings are bent so as to be inverted U-shaped and each of said contact fittings further comprises:

a straight portion connected to said bent terminal portions said straight portion having an upper part and a lower part;

a holding portion formed on said lower part; and a press-in protuberance formed on said upper part, said holding portion having a width greater than that of a corresponding contact pieces and a corresponding bent terminal portion of said bent terminal portions, and said press in protuberance being for engaging with the insertion portions.

14. An electrical connector as in claim 13, wherein each of said contact fittings further includes a holding portion and a press-in protuberance, said press-in protuberance being separated from said holding portion by an intermediate portion of each of said contact fittings.

15. An electrical connector as in claim 13, wherein said stopper ribs are shaped to come in pressure contact with said bent terminal portions.

16. An electrical connector as in claim 13, wherein said electrical connector further includes a first surface, said bent terminal portions being coplanar with said first surface.

17. An electrical connector as in claim 16, wherein said first surface contacts said circuit board.

18. An electrical connector as in claim 13, wherein said bent terminal portions have a constant interval pitch.

19. An electrical connector as in claim 13, wherein each of said contact fittings includes:

a first end connected to a corresponding bent terminal portion of said bent terminal portions;

a second end connected to a corresponding contact piece of said contact pieces; and a press-in protuberance formed at said second end.

* * * * *